US005207270A

United States Patent [19]

Yokoyama et al.

[11] Patent Number: 5,207,270

[45] Date of Patent: May 4, 1993

[54] FIN-TUBE HEAT EXCHANGER

[75] Inventors: Shoichi Yokoyama, Otsu; Hitoshi Motegi, Kusatsu; Osamu Aoyagi; Toshiaki Andoh, both of Otsu, all of Japan

[73] Assignee: Matsushita Electric Industrial Co., Ltd., Osaka, Japan

[21] Appl. No.: 776,776

[22] Filed: Oct. 17, 1991

[30] Foreign Application Priority Data

Oct. 22, 1990 [JP] Japan ..... 2-285034

[51] Int. Cl.[5] ..... F28F 1/32

[52] U.S. Cl. ..... 165/151; 165/182

[58] Field of Search ..... 165/151, 182

[56] References Cited

FOREIGN PATENT DOCUMENTS

| | | | |
|---|---|---|---|
| 55-155193 | 12/1980 | Japan | 165/151 |
| 58-99691 | 6/1983 | Japan | 165/151 |
| 59-210297 | 11/1984 | Japan | 165/151 |
| 63-15096 | 1/1988 | Japan | 165/151 |
| 1-46584 | 2/1989 | Japan | 165/151 |
| 1-179894 | 7/1989 | Japan | 165/151 |

OTHER PUBLICATIONS

#2809143 W. German Date: Aug. 1979 Name: Mason class: 165 sub: 151 see FIGS. 1 & 2.

*Primary Examiner*—Allen J. Flanigan

*Attorney, Agent, or Firm*—Stevens, Davis, Miller & Mosher

[57] ABSTRACT

The fin-tube heat exchanger includes a group of fins arranged parallel to one another at predetermined intervals; cylindrical fin collars formed on each fin at a predetermined column pitch and a predetermined row pitch; and heat transfer tubes extending through the respective fin collars and secured thereto in intimate contact therewith. Seat portions are formed on each fin around the fin collars. A curved protuberance of a generally angular cross-section is formed on the fin adjacent to an outer periphery of each of the seat portions, which has a ridge line of an arcuate or circular shape arranged in concentric relation to the associated fin collar. A plurality of straight protuberances of a generally angular cross-section are formed on each fin adjacent to outer peripheries of the respective seat portions between any two adjacent rows of the fin collars. With this structure, heat transfer performance is improved by a turbulence promoting effect of the straight protuberances. Also an air flow is guided into slip streams behind the heat transfer tubes by the curved protuberances, thereby reducing stagnation zones and increasing the effectively used heat transfer area to improve heat transfer performance.

5 Claims, 6 Drawing Sheets

FIN-TUBE HEAT EXCHANGER

BACKGROUND OF THE INVENTION

This invention relates to a fin-tube heat exchanger for an air conditioner of the heat pump type which utilizes air as a heat source, and more particularly to a fin-tube heat exchanger suitable for use also as the outdoor coil of the air conditioner.

Conventional fin-tube heat exchangers will be described with reference to FIG. 1, FIGS. 2A and 2B and FIGS. 3A and 3B.

As shown in FIG. 1, generally, a fin-tube heat exchanger comprises a group la of fins arranged parallel to one another at equal intervals between any adjacent fins of which an air flow 4 passes; cylindrical fin collars 3 formed in the fin group 1*a* at a predetermined column pitch and a predetermined row pitch, and a group 2*a* of heat transfer tubes extending through the respective fin collars 3 and secured thereto in intimate contact therewith, through each of which heat transfer tubes a fluid flows.

Referring to a fin 1 of FIGS. 2A and 2B for the first conventional fin-tube heat exchanger, seat portions 5 are formed on the fin 1 in concentric relation to fin collars 3, respectively. A plurality of straight protuberances 6 of an angular cross-section are formed on the fin 1 between any two adjacent rows of the fin 1 collars 3, each having a ridge line extending in a direction in which each column of the fin collars extends. With this arrangement, when the air flow 4 passes through the group 1*a* of fins, the heat transfer is enhanced by a turbulence promoting effect.

Referring to a fin 1 of FIGS. 3A and 3B for the second conventional fin-tube heat exchanger, a plurality of juxtaposed, cut and raised portions 7 are formed in the fin 1 between any two adjacent fin collars 3 spaced from each other in the column direction. With this structure, when the air flow 4 passes through the group 1*a* of fins, the heat transfer is promoted by reducing the thickness of the boundary layer adjacent the front edge of the fin surface.

However, in the case where the fin-tube heat exchanger with the fins of FIGS. 3A and 3B is installed on the outdoor side of a heat-pump type air conditioner, frost forms on the front edges of the cut and raised portions 7, which have a good heat transfer performance, during a heating operation of the air conditioner when the outside air temperature falls, and soon the front edges are clogged with the frost. As a result, the heat transfer performance is abruptly lowered, thus posing a problem in that the heating operation could cease entirely due to this clogging.

The fin of FIGS. 2A and 2B is not provided with any cut and raised portion. Therefore, in the case where the fin-tube heat exchanger with these fins is installed on the outdoor side of the air conditioner, the heating operation can be continued for a longer time period even when the outside air temperature falls, as compared with the fin-tube heat exchanger with the fins of FIGS. 3A and 3B. However, since this heat exchanger is designed to promote the heat transfer by the turbulence promoting effect, its heat transfer performance is lower than that of the fin-tube heat exchanger with the fins of FIGS. 3A and 3B designed to promote the heat transfer by reducing the thickness of the boundary layer adjacent the front edge of the fin surface. Therefore, the fin-tube heat exchanger with the fins of FIGS. 2A and 2B has a problem in that it can not achieve a high performance and a compact construction of the heat-pump type air conditioner.

SUMMARY OF THE INVENTION

A fin-tube heat exchanger according to the invention has a high heat transfer performance and can continue a heating operation for a long period of time, even if the heat exchanger is installed on the outdoor side of a heat-pump type air conditioner.

More specifically, according to the invention, a fin-tube heat exchanger includes: a group of fins arranged parallel to one another at predetermined intervals, an air flow passing through a space between any two adjacent ones of the fins; cylindrical fin collars formed in the fin group at a predetermined column pitch and a predetermined row pitch; heat transfer tubes extending through the respective fin collars on the fins and secured to the fin collars in intimate contact with the fin collars, a fluid flowing through each of the heat transfer tubes; seat portions formed on each of the fins in concentric relation to the fin collars, respectively; curved angular protuberances formed on each fin adjacent to respective outer peripheries of the seat portions, each angular protuberance having a ridge line which is arcuate or a circular arranged in concentric relation to the associated fin collar; and a plurality of straight angular protuberances formed in each fin adjacent to respective outer peripheries of the curved angular protuberances between any two adjacent rows of the fin collars, each straight angular protuberance having a ridge extending in a direction of a column of the fin collars and substantially equal in height to the ridge line of the curved angular protuberance.

In one preferred form of the invention, each curved angular protuberance whose ridge line is a concentric arc is formed between crests of two straight angular protuberances whose ridge lines extend in the column direction.

In another preferred form of the invention, each curved angular protuberance whose ridge line is a concentric arc is formed from a crest on windward side one of the straight angular protuberances, whose ridge lines extend in the column direction, to a leeward portion of the adjacent straight angular protuberance.

In still another preferred form of the invention, each curved angular protuberance whose ridge line is a concentric circle with respect to the associated fin color is formed entirely around the fin collar.

With the above structure, the fin-tube heat exchanger of the invention improves in its heat transfer performance by to the turbulence promoting effect of the straight angular protuberances. Also, the air flow is guided into the slip stream of each heat transfer tube by the curved angular protuberance which, in the preferred form of the invention, has an arcuate ridge line between crests of the two straight angular protuberances, thereby reducing stagnation zones of the fins and increasing the effectively used heat transfer area thereof to improve the heat transfer efficiency. Further, in the other preferred form of the invention, the air flow can be more easily guided into the slip stream of each heat transfer tube by a curved angular protuberance having an arcuate ridge line formed from the crest on the windward side of the straight angular protuberances, whose ridge lines extend in the column direction, to a leeward portion thereof, thereby reducing the stagnation zones of the fins and increasing the effective heat transfer area thereof to enhance heat transfer efficiency. Further, in the still other preferred form of the invention, the angular protuberances, each having a circular ridge line entirely surrounding the associated fin collar, can cause eddies in the air flow, thereby promoting heat transfer in the vicinity of the heat transfer tubes.

DESCRIPTION OF THE PREFERRED EMBODIMENTS

The fin-tube heat exchangers according to the preferred embodiments of the invention will now be described with reference to the drawings.

Figure 1:
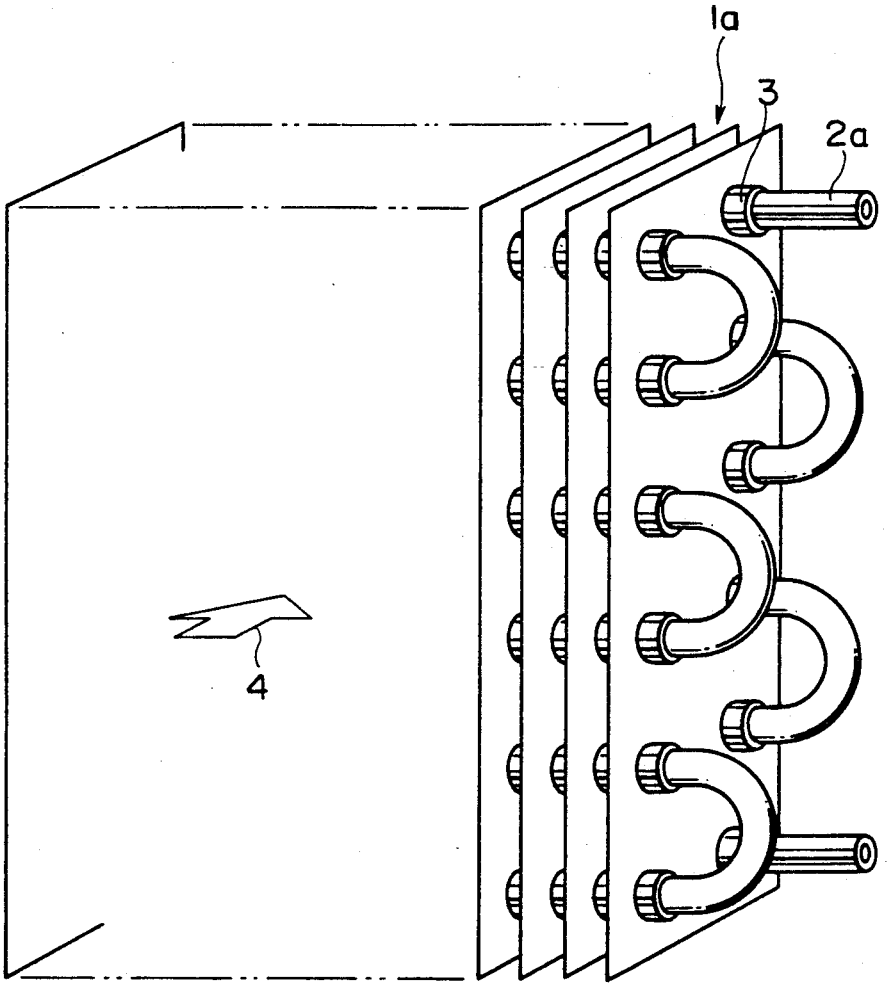
FIG. 1 PRIOR ART
FIG. 1 is a perspective view of a conventional fin-tube heat exchanger of a general type.
Figure 2A:
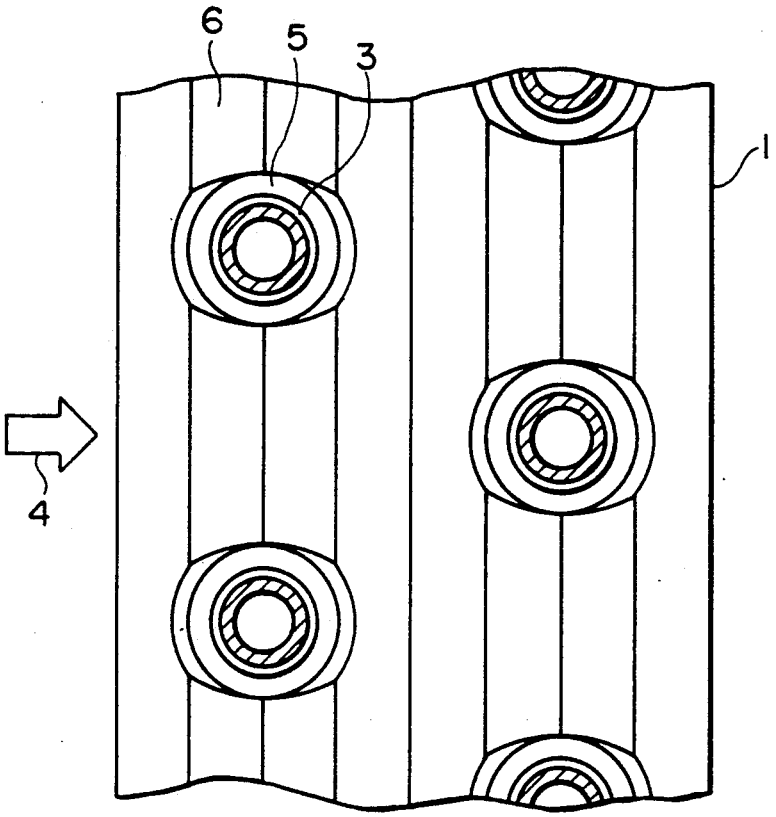
FIG.2A PRIOR ART
FIG. 2A is an elevational view of a fin of a first conventional fin-tube heat exchanger.
Figure 2B:
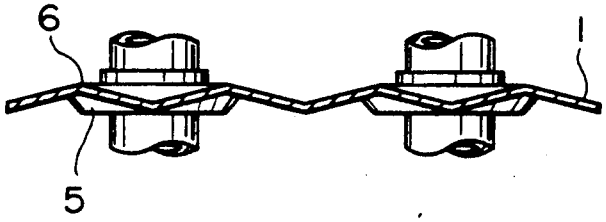
FIG. 2B is a cross-sectional view of the fin of FIG. 2A.
Figure 3A:
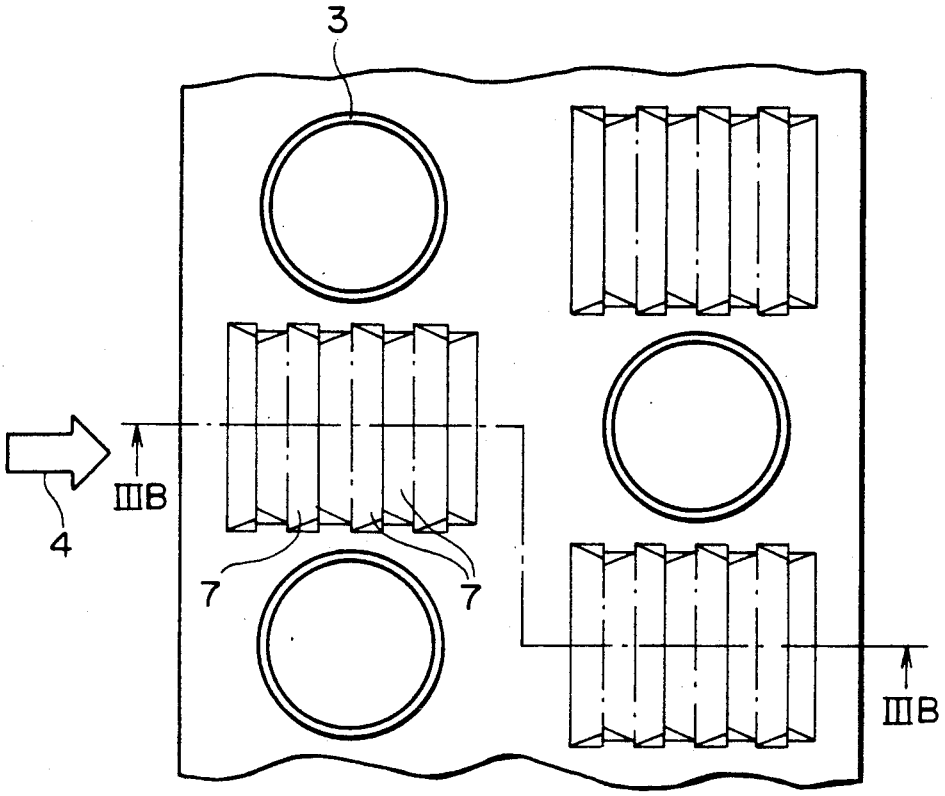
FIG.3A PRIOR ART
FIG. 3A is an elevational view of a fin of a second conventional fin-tube heat exchanger.
Figure 3B:
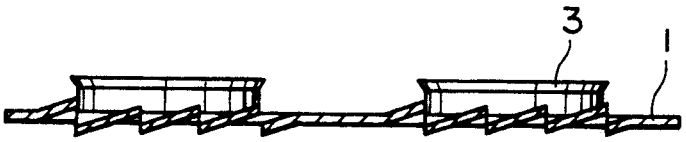
FIG. 3B is a cross-sectional view of the fin of FIG. 3A.
Figure 4A:
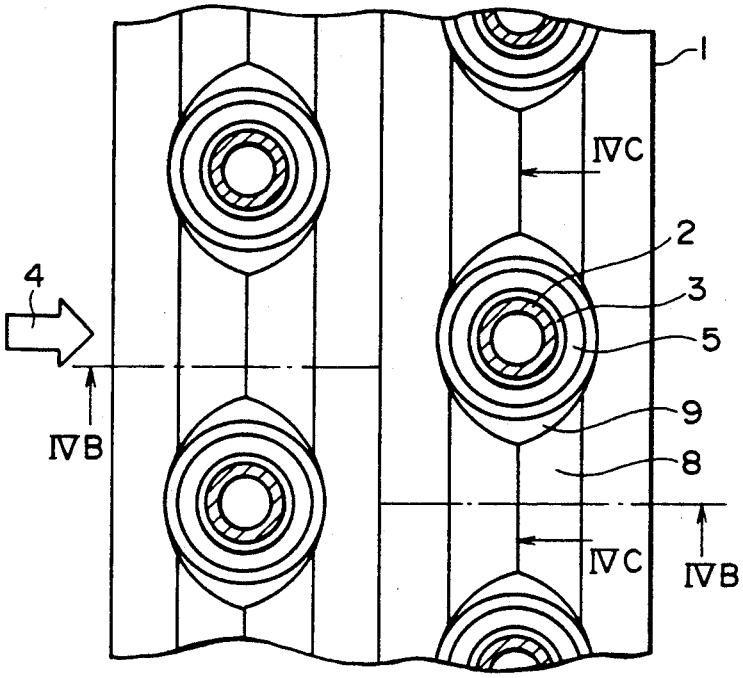
FIG. 4A is a plan view of a fin of a fin-tube heat exchanger according to a first embodiment of the invention.
Figure 4B:
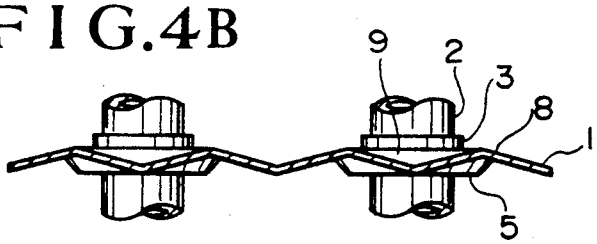
FIG. 4B is a cross-sectional view taken along the line IV B—IV B of FIG. 4A.
Figure 4C:
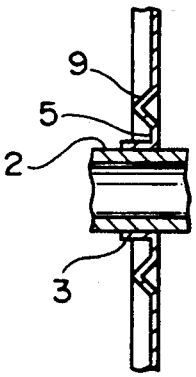
FIG. 4C is a cross-sectional view taken along the line IV C—IV C of FIG. 4A.

FIGS. 4A to 4C show the configuration of a fin of the fin-tube heat exchanger according to the first embodiment of the invention. In these Figures, reference numeral 1 denotes the a fin, reference numeral 2 a heat transfer tube extending through the fin, reference numeral 3 a fin collar formed on, the fin 1 and having the heat transfer tube 2 extending herethrough, reference numeral 4 an air flow passing through the fin-tube heat exchanger, and reference numeral 5 a seat portion formed around the fin collar 3.

A curved protuberance 9 of a generally angular cross-section is formed on the fin 1 adjacent to the outer periphery of the seat portion 5. The protuberance 9 has a ridge line which is arcuate in concentric relation to the fin collar 3 (hereinafter referred to as "concentrically-arcuate ridge line"). Straight protuberances 8 of a generally angular cross-section are formed on the fin 1, each of which has a ridge line extending in a direction of a column of the fin collars. Two straight protuberances 8 are disposed between any two adjacent rows of fin collars 3. The ridge line of the protuberance 9 is substantially equal in height to the ridge line of each straight protuberance 8. The arcuate ridge line of the protuberance 9 is formed between the crests of two protuberances 8 whose ridge lines are straight.

In this first embodiment, the heat transfer performance is improved by the turbulence promoting effect of the straight protuberances 8 and in addition the air flow 4 is guided into slip streams behind the respective fin collars 3 by the curved protuberances 9 each having the concentrically-arcuate ridge lines, thereby reducing stagnation zones and increasing the effectively used heat transfer area to improve the heat transfer performance.

Figure 5A:
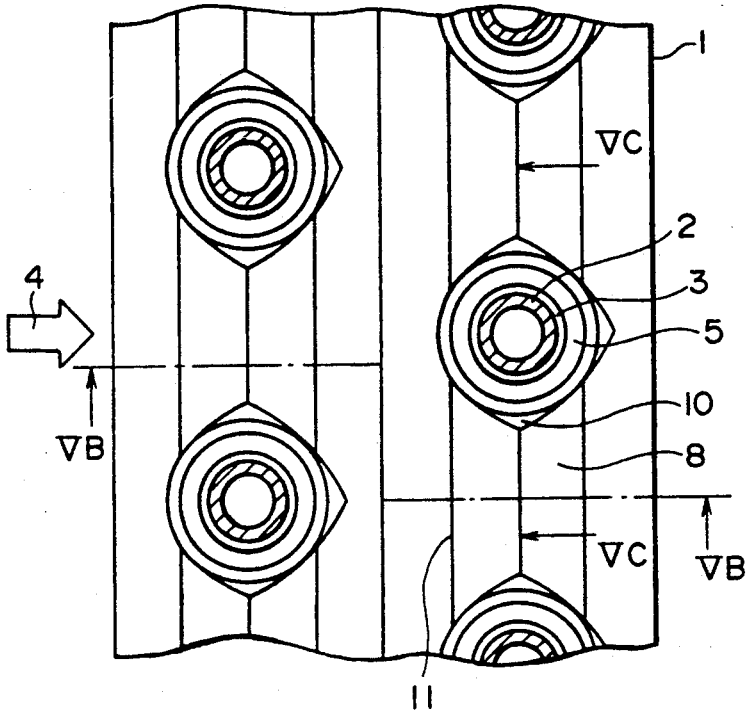
FIG. 5A is a plan view of a fin of a fin-tube heat exchanger according to a second embodiment of the invention.
Figure 5B:
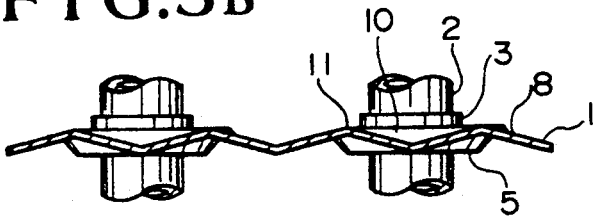
FIG. 5B is a cross-sectional view taken along the line V B—V B of FIG. 5A.
Figure 5C:
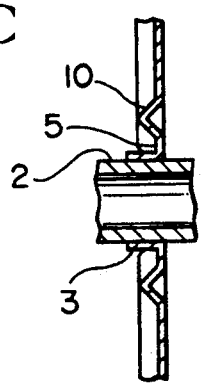
FIG. 5C is a cross-sectional view taken along the line V C—V C of FIG. 5A.

FIGS. 5A to 5C show the configuration of a fin of the fin-tube heat exchanger according to the second embodiment of the invention. In these Figures, reference numeral 1 denotes a fin, reference numeral 2 a heat transfer tube extending through the fin, reference numeral 3 a fin collar formed on the fin 1 and having the heat transfer tube 2 extended therethrough, reference numeral 4 an air flow passing through the fin-tube heat exchanger, and reference numeral 5 a seat portion formed around the fin collar 3.

A curved protuberance 10 of a generally angular cross-section is formed on the fin 1 adjacent to the outer periphery of the seat portion 5. The ridge line of the protuberance 10 is arcuate in concentric relation to the fin collar 3. Straight protuberances 8 of a generally angular cross-section are formed on the fin 1, each of which has a ridge line extending in a direction of a column of the fin collars. Two straight protuberances 8 are disposed between any two adjacent rows of fin collars 3. The ridge line of the curved protuberance 10 is substantially equal in height to the ridge line of each straight protuberance 8. The arcuate ridge line of the protuberance 10 is formed at a leeward side of a crest 11 of a windward one of the two straight protuberances 8 whose ridge lines are straight.

In this second embodiment, the heat transfer performance is improved by the turbulence promoting effect of the straight protuberances 8. Also, since the arcuate ridge line of the protuberance 10 is disposed at the whole leeward side of the crest 11, the air flow 4 is guided into slip streams of the respective fin collars 3 in a more efficient manner than in the first embodiment, thereby reducing stagnation zones and increasing the effectively used heat transfer area to improve heat transfer performance.

Figure 6A:
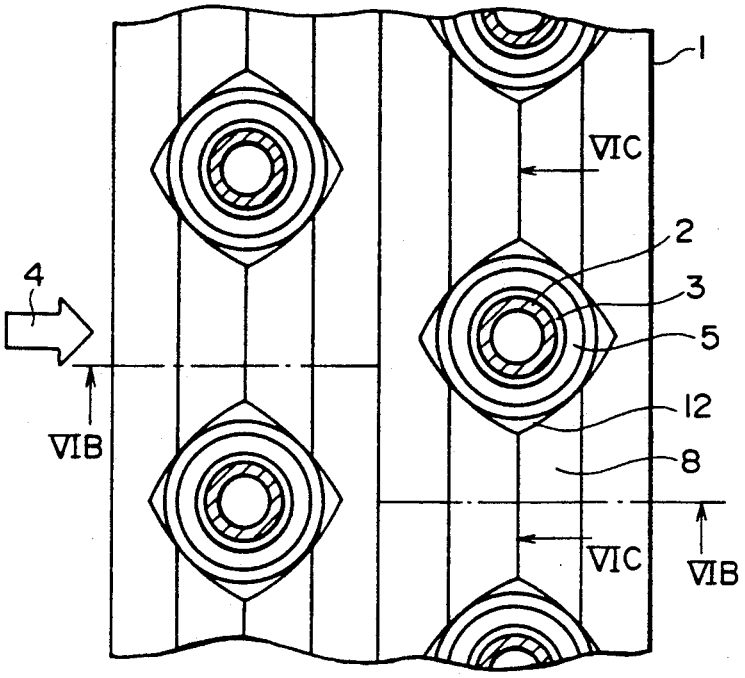
FIG. 6A is a plan view of a fin of a fin-tube heat exchanger according to a third embodiment of the invention.
Figure 6B:
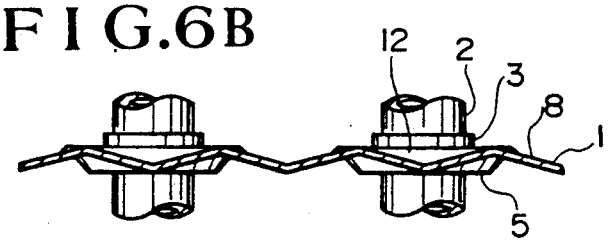
FIG. 6B is a cross-sectional view taken along the line VI B—VI B of FIG. 6A.
Figure 6C:
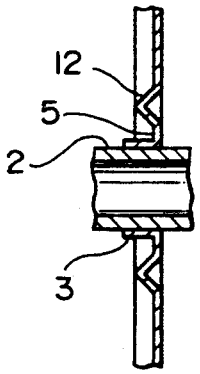
FIG. 6C is a cross-sectional view taken along the line VI C—VI C of FIG. 6A.

FIGS. 6A to 6C show the configuration of a fin of the fin-tube heat exchanger according to the third embodiment of the invention. In these Figures, reference numeral 1 denotes a fin, reference numeral 2 a heat transfer tube extending through the fin, reference numeral 3 a fin collar formed on the fin 1 and having the heat transfer tube 2 extended therethrough, reference numeral 4 an air flow passing through the fin-tube heat exchanger, and reference numeral 5 a seat portion formed around the fin collar 3.

A curved protuberance 12 of a generally angular cross-section is formed on the fin 1 around the outer periphery of the seat portion 5. The circular ridge line of the protuberance 12 is disposed in concentric relation to the fin collar 3. Straight protuberances 8 of a generally angular cross-section are formed on the fin 1, each of which has a ridge line extending in a direction of a column of the fin collars. Two straight protuberances 8 are disposed between any two adjacent rows of the fin collars 3. The ridge line of the curved protuberance 12 is substantially equal in height to the ridge line of each straight protuberance 8.

In this third embodiment, the heat transfer performance is improved by the turbulence promoting effect of the straight protuberances 8. Also, the circular protuberances 12, whose ridge lines are disposed in concentric relation to the respective fin collars 3, cause eddies in the air flow, and these eddies promote heat transfer in the vicinity of the fin collars 3.

As described above, in the fin-tube heat exchanger of the invention, the circular seat portions are formed on the surface of each fin in concentric relation to the respective fin collars, and the curved protuberance whose ridge line is arcuate or circular and is disposed in concentric relation to the associated fin collar is formed adjacent to the outer periphery of the seat portion. The plurality of straight protuberances are disposed between any two adjacent rows of the fin collars. The ridge line of the curved protuberance is substantially equal in height to the ridge line of each straight protuberance. The curved protuberance having the arcuate ridge line is formed between the crests of the two straight protuberances, or the curved protuberance having the arcuate ridge line is formed from the crest of the windward one of the straight protuberances to a leeward portion of the adjacent straight protuberance, or the curved protuberance having the concentric, circular ridge line is formed around the fin collar. With such arrangement, the heat transfer performance is improved of the turbulence promoting effect of the straight protuberances. Also, the air flow is guided into the slip streams of the heat transfer tubes by the curved protuberances, each of which has the arcuate ridge line disposed between crests of the two straight protuberances, thereby reducing the stagnation zones and increasing the effectively used heat transfer area to improve heat transfer efficiency.

Further, in the invention, the air flow can be more easily guided into the slip streams of the heat transfer tubes by the curved protuberances, each of which has the arcuate ridge line formed from crest of the windward one of the straight protuberances to a leeward portion of the adjacent straight protuberance, thereby reducing the stagnation zones and increasing the effectively used heat transfer area to improve the heat transfer efficiency.

Further, in the invention, the curved protuberances, each of which has a circular ridge line entirely surrounding the associated fin collar, can cause eddies in the air flow, thereby promoting the heat transfer in the vicinity of heat transfer tubes.

What is claimed is:

1. A fin-tube heat exchanger comprising:

a plurality of fins arranged parallel to one another at predetermined intervals, wherein an air flow passes between any two adjacent ones of said fins, said air flow having a direction that defines windward and leeward directions;

a plurality of cylindrical fin collars formed on each of said fins in columns and rows at a predetermined column pitch and a predetermined row pitch;

a plurality of heat transfer tubes extending through said fin collars on said fins and secured to said fin collars in intimate contact with said fin collars, respectively, wherein a fluid flows through each of said heat transfer tubes;

a plurality of seat portions formed on each of said fins to encircle concentrically said fin collars, respectively;

a plurality of straight protuberances of a generally angular cross-section formed on each of said fins between any two adjacent rows of said fin collars, each of said straight protuberances having a ridge and having a leeward side located in said leeward direction from said ridge; and a plurality of curved protuberances of a generally angular cross-section formed on each of said fins adjacent to said seat portions, wherein each of said seat portions corresponds to one of said curved protuberances in one-to-one correspondence, each of said curved protuberances including at least two sections, said at least two sections each having an arcuate ridge substantially equal in height to said ridges of said straight protuberances, said at least two sections comprising two sections disposed on opposite sides of a corresponding one of said seat portions and together extending at least partially around the corresponding one of said seat portions between two straight protuberances that are adjacent to said one of said seat portions.

2. A fin-tube heat exchanger according to claim 1, wherein each of said curved protuberances is concentric to a corresponding one of said fin collars.

3. A fin-tube heat exchanger according to claim 1, wherein said at least two sections of said curved protuberances comprise a section extending along a whole leeward side of said one of said seat portions in concentric relation to a corresponding one of said fin collars.

4. A fin-tube heat exchanger according to claim 1, wherein said at least two section extend completely around said one of said seat portions in concentric relation to a corresponding one of said fin collars.

5. A fin-tube heat exchanger according to claim 1, wherein said two sections extend from one of said two straight protuberances to the other of said two straight protuberances.

* * * * *